United States Patent [19]

Schroder

[11] Patent Number: 4,836,336

[45] Date of Patent: Jun. 6, 1989

[54] ELEVATOR SYSTEM FLOOR CALL REGISTERING CIRCUIT

[75] Inventor: Joris Schroder, Lucerne, Switzerland

[73] Assignee: Inventio AG, Hergiswil, Switzerland

[21] Appl. No.: 217,833

[22] Filed: Jul. 12, 1988

[30] Foreign Application Priority Data

Jul. 13, 1987 [CH] Switzerland ..... 02663/87

[51] Int. Cl.[4] ..... B66B 1/18

[52] U.S. Cl. ..... 187/121; 187/125

[58] Field of Search ..... 187/121, 124, 125, 127, 187/128

[56] References Cited

U.S. PATENT DOCUMENTS 3,080,944 3/1963 Burgy et al. ..... 187/128
3,625,311 12/1971 Nowak et al. ..... 187/121
3,804,209 4/1974 Edison ..... 187/124 X
4,691,808 9/1987 Nowak et al. ..... 187/125

*Primary Examiner*—William M. Shoop, Jr.
*Assistant Examiner*—W. E. Duncanson, Jr.
*Attorney, Agent, or Firm*—Marshall & Melhorn

[57] ABSTRACT

A floor call registering circuit for an elevator system includes a keyboard at each floor for inputting the destination floors. The call registering circuit at the main stopping location permits only travels to destination floors which are allocated to a certain group of destination floors. According to an alternate embodiment, the call registering circuit is provided either with a pulse generator or with a decade keyboard. If the keyboard at the main stopping location has keys for all the destination floors, a circuit is provided which frees the destination floor calls allocated to the certain group of destination floors and blocks the destination floor calls lying outside the certain group of destination floors.

16 Claims, 7 Drawing Sheets

ELEVATOR SYSTEM FLOOR CALL REGISTERING CIRCUIT

BACKGROUND OF THE INVENTION

The invention relates in general to an elevator control system and, in particular, to a control system which restricts floor calls at a main floor to certain destination floors.

The single car elevator system typically has a pair of up and down hall call buttons at each floor between the top floor and the bottom floor. These hall call buttons are utilized by prospective passengers to summon the elevator car. Inside the car is an array of car call buttons, one button for each floor served by the car. When two or more elevators operate in an elevator system, it is desirable to coordinate the movements of the elevators to carry out various strategies.

One type of known elevator installation has at least one elevator which services at least one main floor and a number of adjacent floors in response to command input signals for the calling of cars to the floors and for the input of travel destination wishes but is restricted to only travel to one certain group of destination floors. Such systems make it possible to realize and to operate efficient elevator installations of favorable costs, wherein the elevator users benefit from rapid service.

A control system for elevators with double cars is shown in U.S. Pat. No. 3,625,311 in which double cars can serve two adjacent floors at the same time. In this case, the filling of a building can be attained in the shortest possible time with almost uniform occupation of the double cars. At the main stopping floor, the passengers for even-numbered destination floors board the upper car and for the odd-numbered floors board the lower car, wherein the respective car call transmitters for the destination floors not associated with each car are blocked. As soon as the car stops at an upper floor, the block is cancelled so that a passenger boarding can travel to any desired destination floors in an upward direction. The cancellation, initiated by a stop at a floor, of the destination floor block has the disadvantage that the passengers which have boarded the wrong car at the main floor, can now through subsequent actuation of the car call transmitter yet get to the desired destination floors, whereby the efficiency of the elevator installation is greatly reduced.

According to U.S. Pat. No. 3,080,944, a control system for elevators with single cars switches over to zonal operation at high traffic volumes. A first zone comprises the lower floors and a second zone comprises the upper floors. A first group of elevators serves the floors allocated to the first zone and a second group of elevators serves the floors allocated to the second zone. The car call keys of the floors lying outside the respective zone are blocked electrically, whereby only travels to the floors lying within the respective zone can be carried out. During zonal operation, the first group of elevators answers no floor calls during the ascending travel and only "down" floor calls lying within the first zone during the descending travel. The second group of lifts answers all floor calls during the ascending travel and only "down" floor calls lying within the second zone during the descending travel.

The disadvantage of this system lies is that elevators of the second group, by reason of floor calls of the first zone, also stop during the ascending travel when destination requests are present which can not be carried out. The unnecessary stops arising thereby reduce the efficiency of the elevator installation.

SUMMARY OF THE INVENTION

The invention solves the above described problems by providing a hall call registering circuit at a main stopping location which permits only calls to a predetermined group of destination floors. Thus, the efficiency of elevators with a hall call registering circuit in accordance with the present invention is improved.

The advantage to be attained by the invention is essentially that the passengers are practically forced to behave correctly during the utilization of the elevator installation. A further advantage is that the elevators can be used only for permissible travels, whereby the efficiency of the elevator installation is increased. The hall call input keyboard at the main floor has either keys only for the designated floors, or a decade key display with circuit means for blocking out the non-designated floors.

BRIEF DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Illustrated in the FIGS. 1 to 6 is an elevator group with multiple compartment elevator cars, in which at a main stopping location HH, only calls for a certain group of destination floors can be registered at each main floor. An elevator "A" and an elevator "B", each with a multiple compartment car identified as a double car 4 in the following, serve a lower main floor E0, an upper main floor E1, and further floors E2 to En. Each of the floors E0 to En includes shaft doors designated to T0 to Tn respectively to close off the elevator shaft and to provide access to the cars. The double car 4 includes a lower compartment 4.1 and an upper compartment 4.2. The main stopping location HH of the elevators comprises the main floors E0 and E1 in this example of the preferred embodiment. Provided on each of the floors E0 to En is a command input device for calling the cars to the floors and for the input of travel destination wishes.

Provided on the floors E0 to En is a command input device such as a call registering circuit 9 with a keyboard 20 which includes a key for each destination floor. The keyboard 20 of the main floor E0 is equipped only with keys for the even-numbered destination floors and the keyboard 20 of the main floor E1 is equipped only with keys for the odd-numbered destination floors. Designated by 14 is an indicator which shows the waiting passengers whether an arriving compartment 4.1 or 4.2 is provided for the upward calls, the downward calls or not for boarding at all.

In an alternate embodiment, the call registering circuit 9 can be provided, in place of the keyboard 20, with a pulse generator according to Swiss Patent No. 162 810. The generator is in the manner of a telephone number selector which is connected to call memories by way of a circuit for the conversion of the pulse transmitter numbers into floor numbers.

Figure 6:
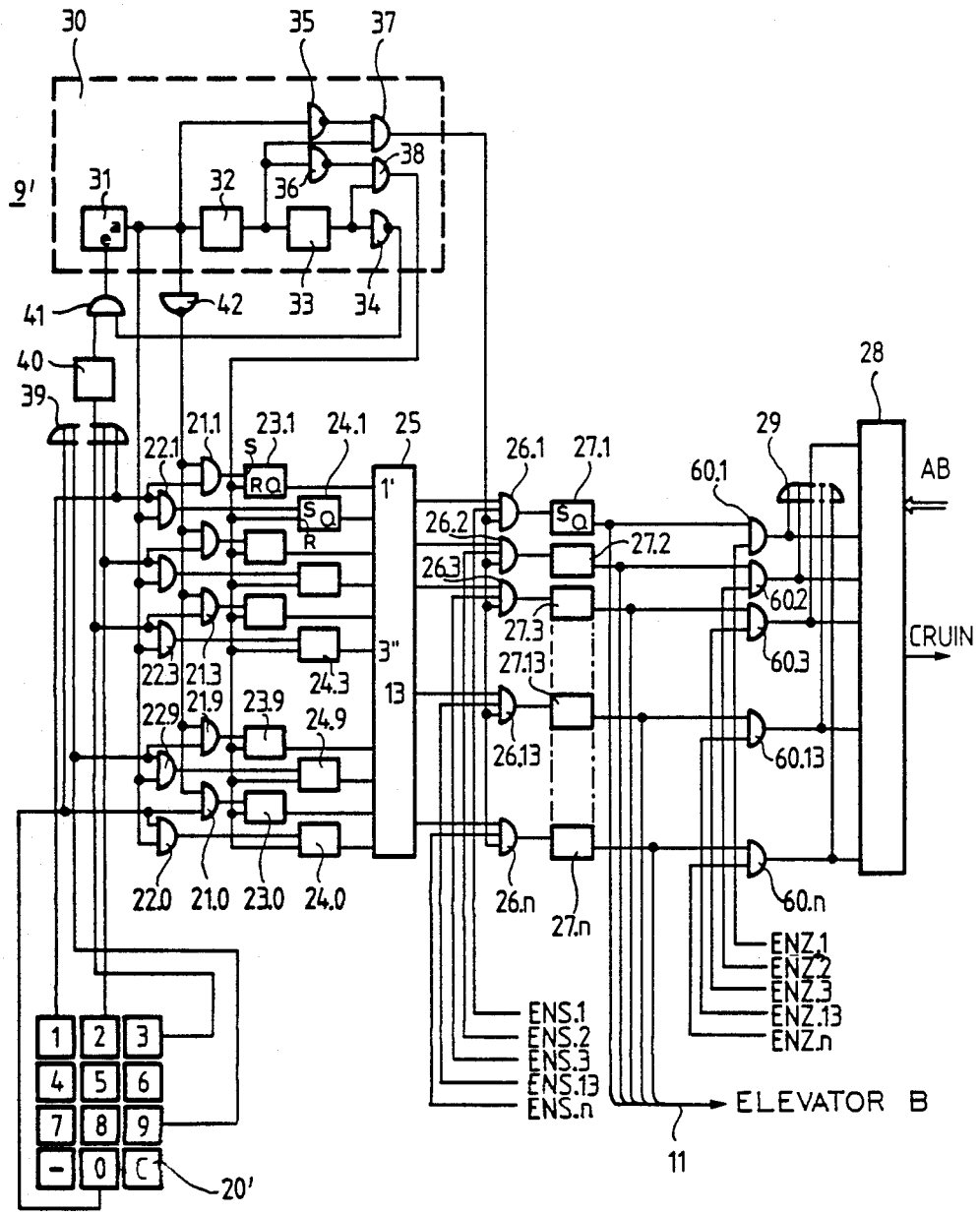
FIG 6 is a circuit diagram of an alternate call registering circuit with a decade keyboard for zonal operation in the control system shown in FIG. 2.

In a further alternate embodiment, a call registering circuit 9' can, in place of the keyboard 20, be provided with a decade keyboard 20' according to FIG. 6. The keyboard 20' includes keys for the input of numerals and control symbols and is connected to call memories by way of a circuit for the conversion of the decade keyboard numbers into floor numbers.

In the pulse transmitter variant, as well as also in the decade keyboard variant, means preventing the acceptance of floor calls for even-numbered and odd-numbered destination floors are provided respectively for the lower main floor E0 and the upper main floor E1.

Figure 1:
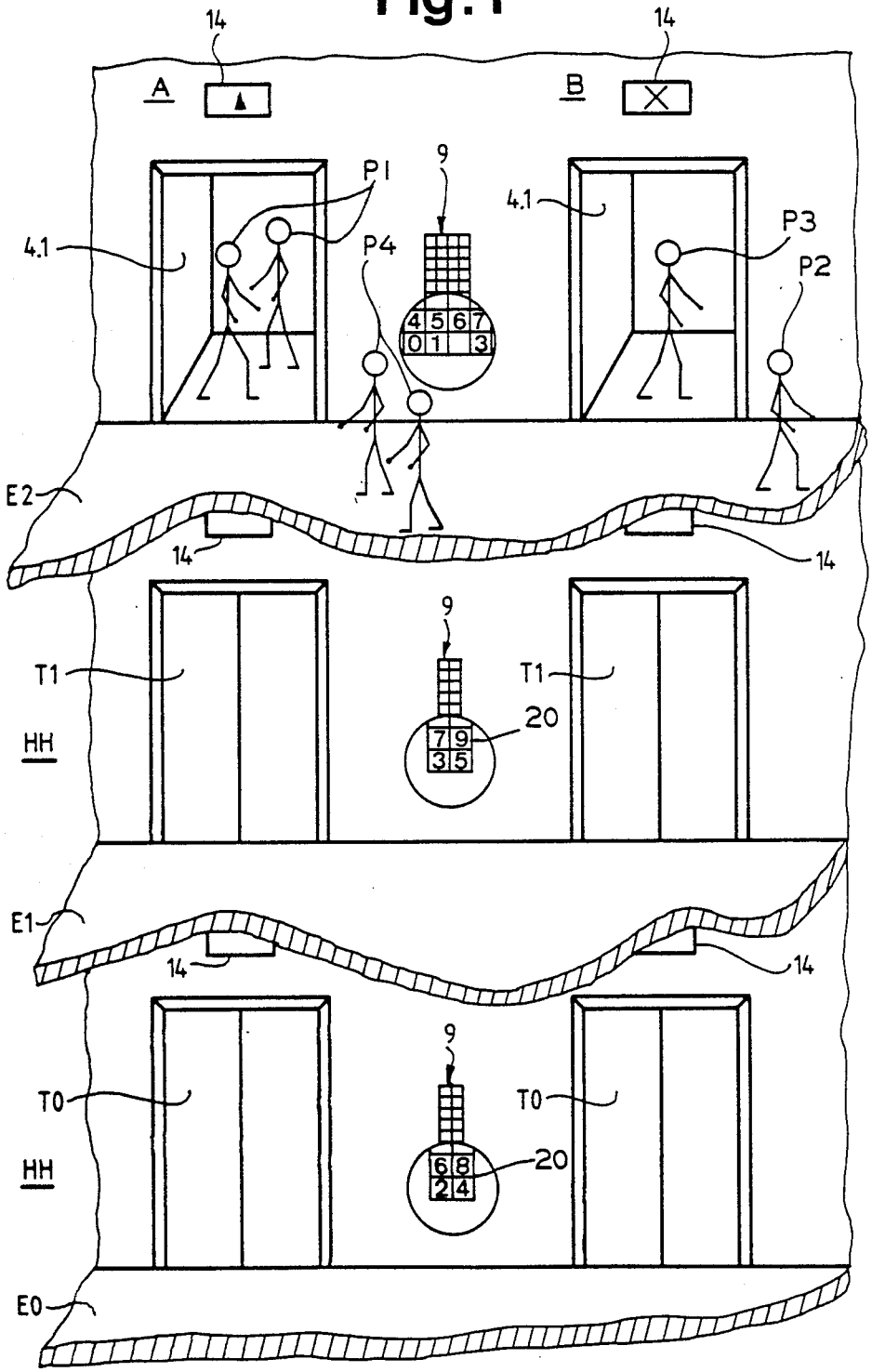
FIG. 1 is a schematic perspective view of three floors served by an elevator group with two double car elevators according to the present invention.

In FIG. 1, the lower compartment 4.1 of the double car 4 of the elevator "A" is disposed for upward travel and is shown during a floor stop at the floor E2. It is assumed that two passengers P1 with chosen destination floors E4 and E6 have already boarded at the main floor E0. At the same time, the lower compartment 4.1 of the double car 4 of the elevator "B" is disposed for downward travel and arrives at the floor E2. A passenger P2 leaves the compartment 4.1 and a passenger P3 with destination floor E0 remains in the compartment 4.1. Both the passengers P4 waiting at the floor E2 with destination floors E7 and E9 would not know without an indicator 14 whether elevator "A" or elevator "B" serves their destination floors. An arrow, lighting up in green on the indicator 14 of the elevator "A" on the arrival of the compartment 4.1, indicates to the passengers P4, to which elevator their destination floors were allocated for service. On the indicator 14 of the elevator "B" at the floor E2, a red X-symbol appears, which indicates to the waiting passengers P4 that they may not board, since no destination floors desired at the floor E2 were allocated to the elevator "B" for service. The compartments 4.1 and 4.2 include load measuring devices for the determination of the car load. Also detected by these devices are passengers who have boarded without inputting or registering their destination floor. Arranged in the compartment 4.1 and 4.2 is a position signaller (not illustrated) which indicates the respective stopping floor to the car passengers.

Figure 2:
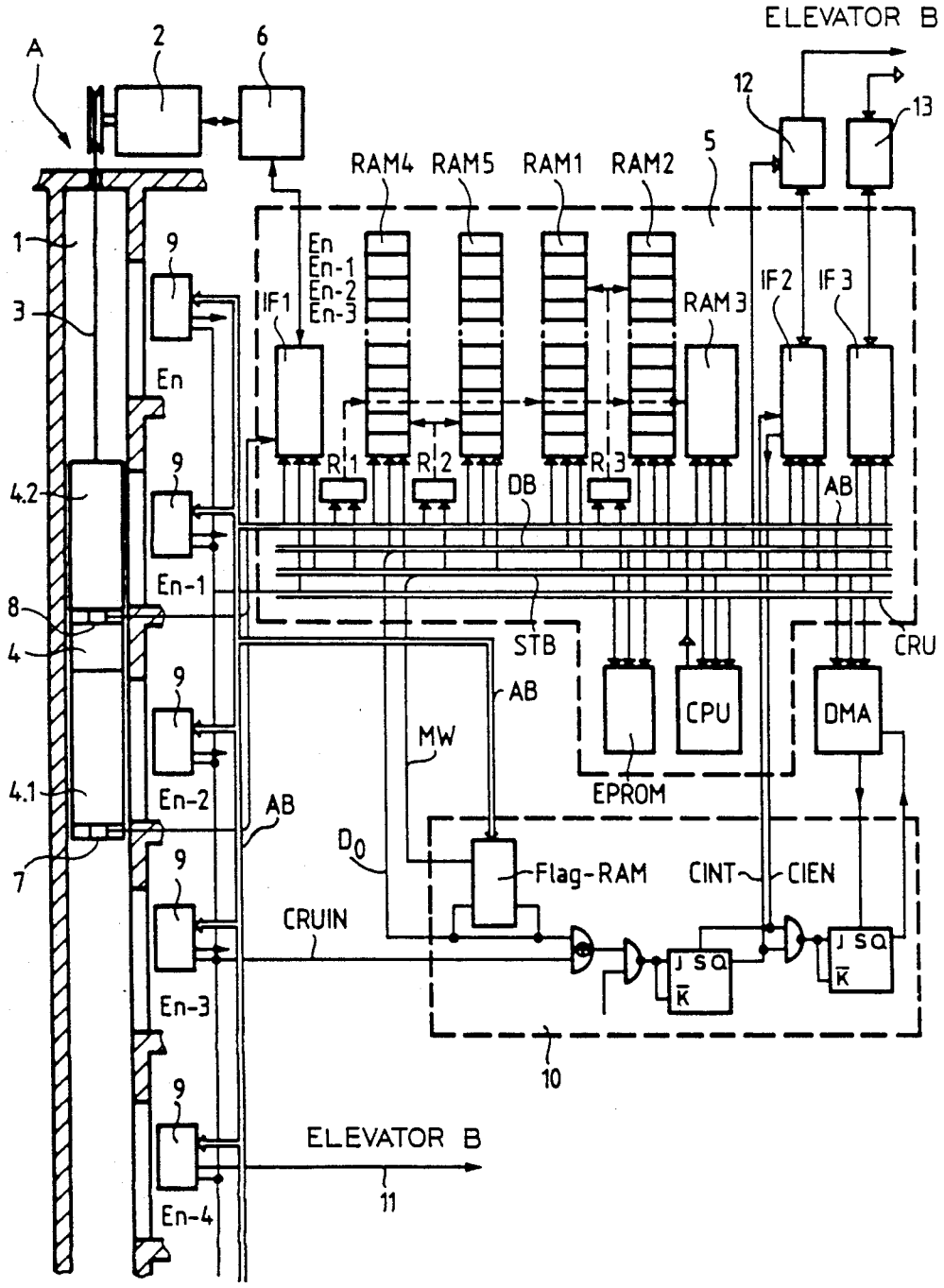
FIG. 2 is a partial schematic and circuit diagram of the control system for the elevator group shown in FIG. 1.

Designated by 1 in FIG. 2 is an elevator shaft of the elevator "A". A hoist motor 2, by way of a hoist cable 3, drives the double car 4 with the lower compartment 4.1 and the upper compartment 4.2 guided in the elevator shaft 1, wherein floors E0 to En are served, of which merely the uppermost floors En-4 to En are illustrated. The hoist motor 2 is controlled by a drive system 6, wherein the target value generation, regulating functions and the stop initiation are realized by means of a microcomputer system 5. The drive system 6 is connected by way of a first interface IF1 with the microcomputer system 5. The compartments 4.1 and 4.2 include load measuring devices 7 and 8, which are likewise connected by way of the first interface IF1 with the microcomputer system 5. Provided on the floors are call registering circuits 9, which are described in more detail with the aid of FIG. 3 and FIG. 6, and by means of which calls can be inputted for travels to desired destination floors. Call registering circuits 9 are connected by way of an address bus AB and a data input conductor CRUIN of a serial input and output bus CRU with the microcomputer system 5. The conductor CRUIN is an input to circuits which are shown in the European Patent No. 0 062 141 and consist of a comparison circuit 10 and a DMA-block DMA. The call registering circuits 9 furthermore are connected by way of lines 11 with the microcomputer system and the input circuit of the elevator "B".

Figure 4:
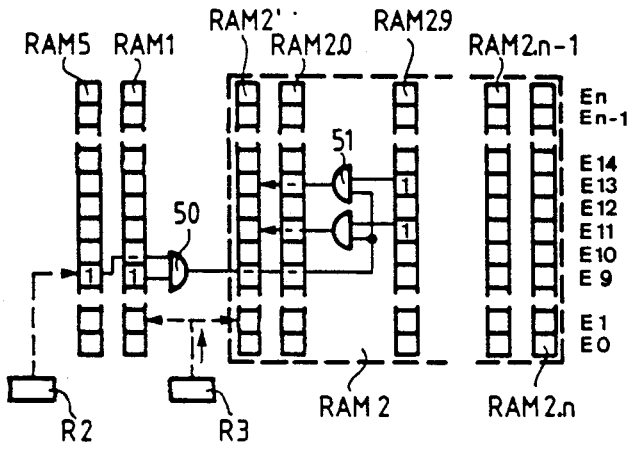
FIG. 4 is a circuit diagram of the destination floor call memory of FIG. 2 and a coincidence circuit for the call allocation.

The microcomputer system 5 consists of a floor call memory RAM1, a destination floor call memory RAM2 described in more detail with the aid of the FIG. 4, a car load memory RAM3 for storing the instantaneous car load of the compartments 4.1 and 4.2, a respective cost memory RAM4 for upward and downward travel directions, a respective allocation memory RAM5 for upward and downward directions, a program memory EPROM and a microprocessor CPU which are all connected together by way of the address bus AB, a data bus DB and a control bus STB. Designated by R1 and R2 are a first and a second scanner of a scanning circuit, wherein the scanners R1 and R2 are registers, by means of which addresses corresponding to the floor numbers and the travel direction are formed. Designated by R3 is a selector in the form of a further register, which when the car is travelling indicates the address of the next floor at which the car could still stop. Destination travels, which are compared with a destination travel generated in a target value transmitter, are allocated to the selector addresses. On equality of the travels and the presence of a stopping command, the retardation or stopping phase is initiated. When no stopping command is present, then the selector R3 is switched to the next floor.

The microcomputer systems 5 of the individual elevators "A" and "B" are each connected with the other by way of the cost comparison circuit 12 which is shown in European Patent No. 050 304 and a second interface IF2, as well as by way of a party line transmission system 13 shown in European Patent No. 050 305 and a third interface IF3.

Figure 3:
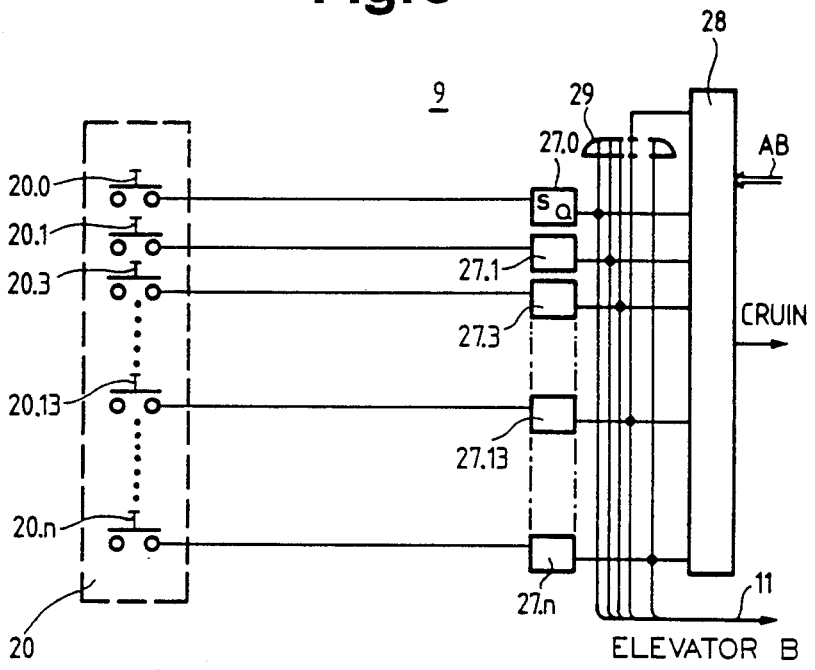
FIG. 3 is a circuit diagram of the call registering circuit with keyboard of FIG. 2.

The call registering circuit 9 of the floor E2 is shown in more detail in FIG. 3. The keyboard 20 has a key for each destination floor except for the floor E2. A similar keyboard 20 for the main floor E0 is equipped only with keys for the even-numbered destination floors and the keyboard 20 of the main floor E1 is equipped only with keys for the odd-numbered destination floors. In an alternative embodiment, the call registering circuits 9 at the main floors can have a keyboard 20 which has only keys respectively for even-numbered and odd-numbered destination floors which lie within a certain zone. In another embodiment, in zonal operation, at least one call registering circuit 9'', according to FIG. 8 and common to the elevators "A" and "B", has a keyboard which includes keys for all destination floors. In this variant, the passengers are informed by means of an indictor, which is not illustratead, which group of destination floors is serviced by which elevator.

Figure 7:
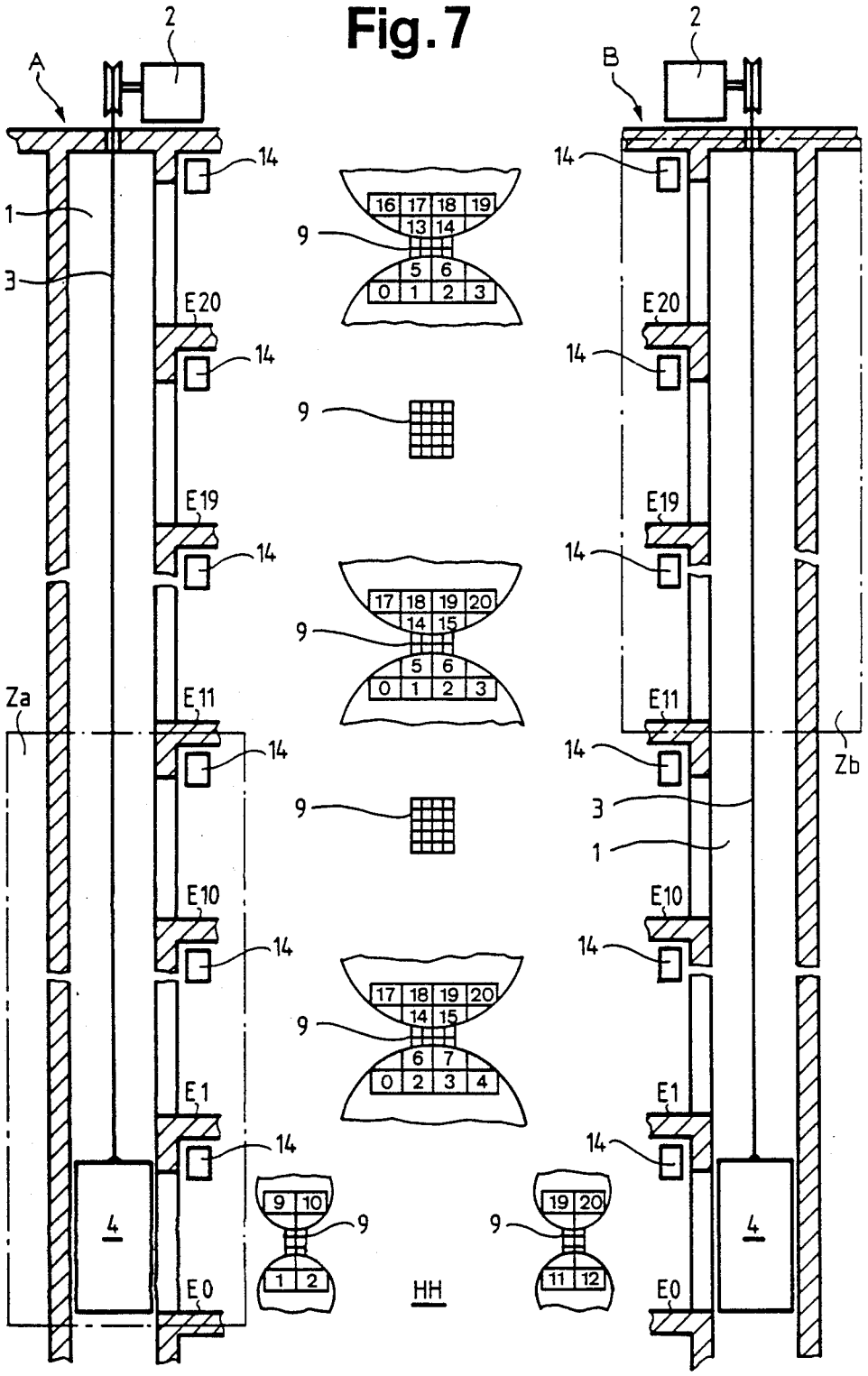
FIG. 7 is a schematic representation of an elevator group with two single cars in zonal operation according to the present invention.

Both variants of the preferred embodiment of the call registering circuit 9 also permit zonal operatoin, which is explained in more detail with respect to FIG. 7, in lit groups with multiple car elevators. The variant with keyboard and keys for all destination floors permits zonal operation with zones adaptable to the traffic volume and/or blocking respectively of the even-numbered and odd-numbered destination floor calls of the main stopping location HH.

As shown in FIG. 3, the keys 20.0 to 20.n of the destination floors E0 to En respectively are connected with the inputs S of floor call memories 27.0 to 27.n respectively. The outputs Q of the call memories 27.0 to 27.n are connected with inputs of a multiplexer 28 and an OR-member 29, the output of which is connected to the first input of the multiplexer 28. The multiplexer 28 is connected with the address bus AB and is connected at an output with the data input conductor CRUIN. The outputs Q of the call memories 27.0 to 27.n are connected by way of the lines 11 with the multiplexer 28 and the OR-member 29 of the elevator "B".

By way of the multiplexer 28, the call memories 27.0 to 27.n can be scanned and stored floor calls transferred into the microcomputer system 5 of the elevator concerned. In this case, on the presence of at least one call, the first input of the multiplexer 28 is activated by way of the OR-member 29 and the associated address is interpreted as the address of a floor call. The addresses associated with the remaining inputs of the multiplexer 28 are interpreted as addresses of destination floor calls.

As is shown in the European Patent No. 0 062 141, mentioned in the description concerning FIG. 2, the transfer of the calls into the microcomputer system 5 takes place when the microprocessor CPU signals its readiness for the acceptance of interruption demands on a line CINT (FIG. 2) by a release signal on a line CIEN. The DMA-block is activated by the release signal and takes over the control by way of the address bus AB and the serial input and output bus CRU. By means of the addresses now produced by the DMA-block, the call memories 27.0 to 27.n of the call registering circuits 9 and a read-write memory Flag-RAM of the comparison circuit 10 are interrogated. The contents of the call memories 27.0 to 27.n and the associated storage spaces of the read-write memory Flag-RAM are compared one with the other in the comparison circuit 10. On inequality, the DMA-operation is terminated and an interruption demand is generated on the line CINT. The microprocessor CPU now carries out an interrupt program, during which it reads the data bit disposed on the data input conductor CRUIN and writes it under the address disposed on the address bus AB into the floor call memory RAM1 or into the destination floor call memory RAM2 and by way of a data conductor $D_0$ of the data bus DB into the read-write memory Flag-RAM.

The destination floor call memory RAM2 shown in FIG. 4 includes a first memory RAM2', which has storage spaces corresponding to the number of the floors and in which already allocated calls are stored. Designated by RAM2.0 to RAM2.n are further memories allocated to the floors E0 to En, which likewise have storage spaces corresponding to the number of floors. Merely those calls, which have been inputted at the floors concerned and have not yet been allocated to a certain car, are transferred by means of the process described in the preceding section into the further memories RAM2.0 to RAM2.n. The first memory RAM2', the further memories RAM2.0 to RAM2.n, the floor call memory RAM1 and the allocation memory RAM5 are interlinked by way of a coincidence circuit symbolized by AND-members 50 and 51. The coincidence circuit, which is formed on each setting of the second scanner R2 by the microprocessor CPU by reason of a program, has the effect that on coincidence of an allocation instruction and a floor call at the same floor, the calls stored in the allocation memory are transferred into the first memory RAM2', by which they are allocated and released for the scanning by the selector R3. According to the chosen example, merely the allocation memory RAM5 for the upward travel direction is illustratead in FIG. 4. The allocation of a floor call and the calls inputted at a floor for desired destination floors takes place in similar manner as shown in the European Patent No. 0 032 213.

Figure 5:
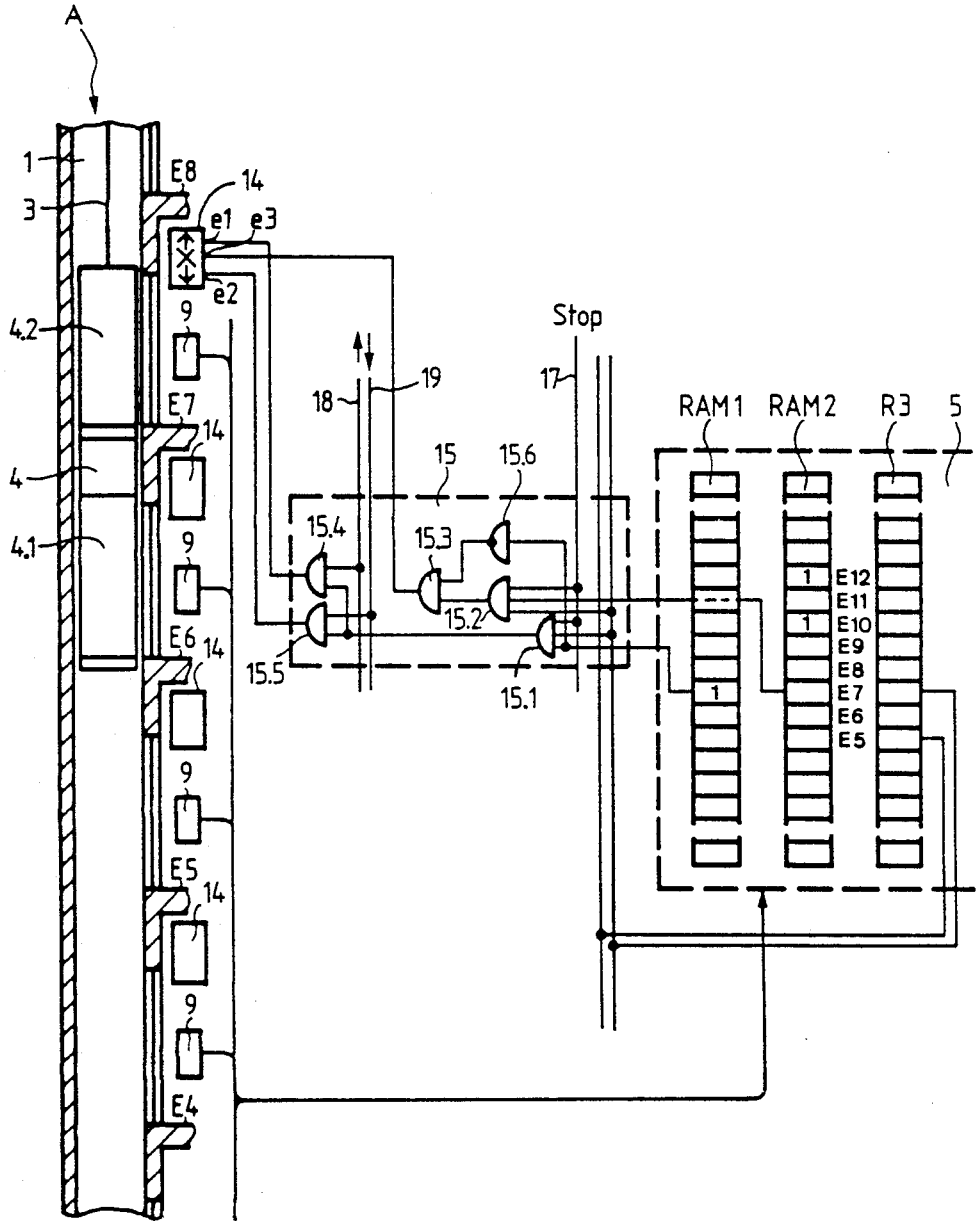
FIG. 5 is a partial schematic and circuit diagram of a switching circuit in the control system of FIG. 2 for the driving of indicators for informing the waiting passengers whether the desired destination floors are or are not allocated to an arriving car.

Designated by 15 in FIG. 5 are switching circuits, which are associated with the floors and connected at the input side with the microcomputer system 5 and at the output side with indicators 14 arranged at the floors. The switching circuits 15, illustrated merely for the floor E7, consist of a first and a second AND-member 15.1 and 15.2 each having three inputs, a third, fourth and fifth AND-member 15.3, 15.4 and 15.5 each having two inputs and a NOT-member 15.6. The first and the second AND-members 15.1 and 15.2 are each connected by way of a respective input with an output, associated with the floor concerned, of the selector R3 and by way of a respective other input with a conductor 17 which on stopping at a floor carries a Stop signal. The first AND-member 15.1 is connected by way of a further input to the output of the storage cell, associated with the floor concerned, of the floor call memory RAM1. The further input of the second AND-member 15.2 is connected with that output of the destination floor call memory RAM2 which is associated with the same floor. The output of the first AND-member 15.1 is connected with a respective input of the fourth and fifth AND-members 15.4 and 15.5. The other input of the fourth AND-member 15.4 is connected to a conductor 18 carrying an upward further travel signal, whilst the other input of the fifth AND-member 15.5 is connected with a conductor 19 carrying a downward further travel signal. The output of the fourth AND-member 15.4 is connected with a first output e1 and that of the fifth AND-member 15.5 with a second input e2 of the indicator 14. The one input of the third AND-member 15.3 is connected to the output of the second AND-member 15.2, whilst the other input is connected by way of the NOT-member 15.6 with that output of the storage cell of the floor call memory RAM1 which is associated with the floor concerned. The output of the third AND-member 15.3 is connected with a third input e3 of the indicator 14.

The indicator 14 consists of a first and a second indicating element in the form of an upward or downward arrow and of a third indicating element in the form of an X-symbol signalling the boarding prohibition. The indicating elements are formed by luminescent diodes which can be fastened on a printed circuit board and covered by means of a plate perforated in correspondence with the indicator symbols. On activation of the indicating elements by way the inputs e1, e2 and e3, the first and second indicating elements light up in green and the third indicating element in red.

Let it be assumed that a floor call for floor E7 and two calls put in at this floor for destination floors E10 and E12 were allocated to the compartment 4.2 of the elevator disposed in upward travel, wherein these calls were stored in the floor or destination floor call memories RAM1 and RAM2 and are characterized by "1" in accordance with the usual logic symbolism. Since on the stopping of the compartment 4.2 at the floor E7 according to the logic chosen by way of example, the selector signal, the stop signal and the upward further travel signal are logic "1", the first indicating element e1 is activated by way of the first and fourth AND-members 15.1 and 15.4 at the first input of the indicator 14. In this case, the upward arrow lights up in green, whereby it is indicated to the waiting passengers that the compartment 4.2 will serve the calls registered by them.

The position signalers arranged in the compartments are controlled by switching circuits similar to the switching circuit 15. The selector R3 illustrated in FIG. 5 each time signals that floor at which the travelling car 4 could still stop in the presence of a stop command. Through logical interlinking of this information with the information present on the conductor 17, the position signaller indicating the respective stopping floor lets itself be controlled.

Illustrated in the FIG. 6 is a call registering circuit 9', which is provided for the floor E0 and which in place of the keyboard 20 displays a decade keyboard 20'. This variant of the call registering circuit 9 also permits zonal operation, which is explained in connection with FIG. 7, in the case of elevator groups with multiple car elevators with zones adaptable to the traffic volume and/or blocking of either the even-numbered or the odd-numbered destination floor calls of the main stopping location HH. In that case, at least one call registering circuit 9' according to FIG. 6 is mounted on the floors E0 and E1 forming the main stopping location HH. The main stopping location HH is not restricted to the named floors. Normally, in the case of multiple car elevators, those floors which display a high traffic volume become the main stopping location HH.

According to FIG. 6, the call register circuit 9', designed for example for single-digit and two-digit calls, consists of a keyboard 20', which displays ten keys for the numerals zero to nine for the call input to desired destination floors. An eleventh key, designated by "—", can for example be used as a preselector key for calls for floors lying below the ground floor, wherein the ground floor is indicated by the numeral zero. A twelfth key, designated by "C", can be used for further purposes, such as for example as a preselector key for the coded input of calls. The keys of the numerals zero to nine are connected to first inputs of first AND-members 21.0 to 21.9, the outputs of which are connected with inputs S of key memories 23.0 to 23.9 for the storage of a numeral first put in. The keys of the numerals zero to nine are furthermore connected with first inputs of second AND-members 22.0 to 22.9, the outputs of which are connected with inputs S of key memories 24.0 to 24.9 for the storage of a numeral put in second. RS flip-flops can for example be used as the key memories. The outputs Q of all key memories are connected with the inputs of a combinatorial logic 25, the outputs of which are connected to first inputs of third AND-members 26.1 to 26.n, which at the output side are connected with inputs S of call memories 27.1 to 27.n, for example in the form of RS flip-flops, allocated to the floors.

The combinatorial logic 25 operates in such a manner that one of the call memories 27.1 to 27.9 associated with the floors E1 to E9 is set on the input of a single-digit call and one of the call memories 27.10 to 27.n associated with the floors E10 to En is set on the input of a two-digit call. When calls are for example put in the floors E1 and E13, then the combinatorial logic 25 must fulfil the equations.

$$1 = 1'\ 2'\ 3' \ldots 9'\ 0'\ 1''2'' \ldots 9''\ 0'' \text{ and}$$

$$13 = 1'\ 2'\ 3' \ldots 9'\ 0'\ 1''\ 2''\ 3'' \ldots 0''\ 0'',$$

wherein the input variables 1', 2', 1' . . . signify the numeral put in first and 1'', 2'', 3'' . . . signify the numeral put in second and the output variables 1 and 13 designate the selected destination floors E1 and E13.

The outputs Q of the call memories 27.1 to 27.n are connected to first inputs of fourth AND-members 60.1 to 60.n, which are connected at the output side with inputs of a multiplexer 28 and an OR-member 29, the output of which is connected to the first input of the multiplexer 28. The multiplexer 28 is connected with the address bus AB and is connected at the output side to the data input conductor CRUIN. The outputs Q of the call memories 27.1 to 27.n are connected by way of the lines 11 with the multiplexer 28 and the OR-member 29 of the elevator "B". Conductors ENS.1 to ENS.n are connected to the third inputs of the third AND-members 26.1 to 26.n. The second inputs of the fourth AND-members 60.1 to 60.n are connected with the conductors ENZ.1 to ENZ.n.

Designated by 30 is a time limitation switch for the call input, which switch consists of a monoflop 31, a first and second delay member 32 and 33, a first, second and third NOT-member 34, 35 and 36 and a first and second AND-member 37 and 38 each having two inputs. The keys of the numerals zero to nine are connected by way of an OR-member 39, a further delay member 40 and a further AND-member 41 having two inputs with the input e of the monoflop 31. The output a of the monoflop 31 is connected to the input of the first delay member 32, at the second inputs of the second AND-members 22.0 to 22.9 and by way of a further NOT-member 42 to the second inputs of the first AND members 21.0 to 21.9. The output of the first delay member 32 is connected with the input of the second delay member 33, the output of which is connected by way of the first NOT-member 34 to the second input of the first AND-member 41. Logic blocks connected in series can for example be used as delay members, wherein the delay time results from the signal transit time. The output a of the monoflop 31 is connected by way of the second NOT-member 35 with an input of the first AND-member 37, the second input of which is connected to the output of the first delay member 32 and the output of which is connected to second inputs of third AND-members 26.1 to 26.n connected in front of the call memories 27.1 to 27.n. The output of the first delay member 32 is connected by way of the third NOT-member 36 with an input of the second AND-member 38, the second input of which is connected to the output of the second delay member 33 and the output of which is connected to reset inputs R of the key memories.

The aforedescribed call registering circuit 9' operates as follows: on the input of a call, for example for floor E13, the key of the numeral one is actuated first, for which a short pulse is generated and merely the key memory 23.1 is set because the first AND-members 21.0 to 21.9 have been released by way of the further NOT-member 42. After a dealy caused by the further delay member 40, the monoflop 31 is switched so that the output of the further NOT-member 42 is set low and th first AND-members 21.0 to 21.9, which are associated with the key memories 23.0 to 23.9 for the input of the first numeral, are blocked. At the same time, the second AND-members 22.0 to 22.9, which are associated with the key memories 24.0 to 24.9 for the input of the second numeral, are freed. Let it now be assumed that the switching-on time of the monoflop 31 amounts to one second and the key of the number three is still actuated during this time. In this case, the key memory 24.3 is set so that the combinatorial logic 25 displays the input variables 1' and 3" and the output variable 13 associated with the call memory 27.13 for floor E13.

Due to the falling trailing edge of the output signals of the monoflop 31 and of the first delay member 32, a pulse is produced at the output of the first AND-member 37, by means of which pulse the third AND-members 26.1 to 26.n are freed and the call memory 27.13 associated with the floor E13 is set when the line ENS.13 is at logic "1". Just so, due to the falling edges of the output signals of the first and second delay members 32 and 33, respectively, a further pulse is produced at the output of the second AND-member 38, by means of which pulse all key memories are reset. By the falling edge of the second delay member 33 pulse, the monoflop 31 is freed by way of the first NOT-member 34 and the further AND-member 41 so that a further call can be inputted.

For the blocking of either the even-numbered or odd-numbered destination floor calls at the main stop HH in the case of elevator groups with multiple car elevators, the conductors ENS.1 to ENS.n are acted on manually or automatically by a logic "0" or a logic "1". Accordingly, the lines ENZ.1 to ENZ.n are set to logic "1" or logic "0" so that the third AND-members 26.1 to 26.n and the fourth AND-members 60.1 to 60.n are free only for either even-numbered or odd-numbered destination floors. In zonal operation, apart from the blocking of either even-numbered or odd-numbered destination floor calls at the main stopping location HH, a first zone Za with for example the destination floors E1 to E19 is allocated to the elevator "A" in that the fourth AND-members 60.1 to 60.19 are freed by means of the lines ENZ.1 to ENZ.19. A second zone Zb with the destination floors E20 to En is allocated to the elevator "B" in analogous manner. By means of an indicator, not shown, the passengers at the main stopping location HH learn which group of destination floors is served by which elevator.

By way of the multiplexer 28, the fourth AND-members 60.1 to 60.n can be scanned and the calls stored in the call memories 27.1 to 27.n can be transferred into the microcomputer system 5 of the associated elevator. In this case, the first input of the multiplexer 28 is activated by way of the OR-member 29 on the presence of at least one call and the associated address is interpreted as the address of a floor call. The addresses associated with the remaining inputs of the multiplexer 28 are interpreted as addresses of car calls, wherein a first part of the address designates the destination floor and a second part of the address serves as a selection code of the multiplexer concerned and designates that floor, at which the call for the destination floor was inputted.

Illustrated in FIG. 7 is an elevator group in single-car elevators, in which only destination floors of a certain group of destination floors can be inputted for each elevator at the main stopping location HH. The elevator group with the elevator "A" and the elevator "B" in zonal operation is controlled substantially by the circuits explained in connection with FIGS. 2 to 6. The hoist motor 2 by way of the hoist cable 3 drives the single car 4 guided in the elevator shaft 1. Indicators 14 arranged at the floors indicate to the waiting passengers whether an arriving car 4 is provided for the upward calls, the downward calls or not at all for boarding. The construction and the function of the indicator 14 is explained in connection with FIG. 5. Call registering circuits 9, by means of which calls can be inputted for travels to desired destination floors, are provided at the floors. At the main stopping location HH covering the floor E0, at least two call registering circuits 9 are arranged, and at least one call registering circuit 9 being arranged on each of the remaining floors. The construction and the function of the call registering circuit 9 is explained in connection with FIG. 3. Provided according to FIG. 7 at the main stopping location HH is a first call registering circuit 9 with a keyboard which has keys for the input of destination floors which lie within the first zone Za associated with the elevator "A". The keyboard of a second call registering circuit 9 arranged at the main stopping location HH has keys for the input of destination floors which lie within the second zone Zb associated with the elevator "B". The lines 11 illustrated in FIG. 3 are not required in this case. Provided at the floors E1 to E20 are call registering circuits 9 with keyboards which have a key for each destination floor, wherein the destination floor selection for each floor takes place by way of a call registering circuit 9 common to the elevators "A" and "B".

In the example of the embodiment of FIG. 7, only the destination floors E1 to E10 of the first zone Za can be inputted by means of the first call registering circuit 9 of the elevator "A" at the main stopping location HH. When a passenger wants to travel for example from the main stopping location HH to the floor E19, then he must put in his destination floor by means of the second call registering circuit 9 of the elevator "B". In buildings with very great traffic volume from the main stopping location HH to, for example, the floors E1 to E5, a first zone Za covering only these floors and a second zone Zb covering the same and/or the remaining floors can be provided.

Figure 8:
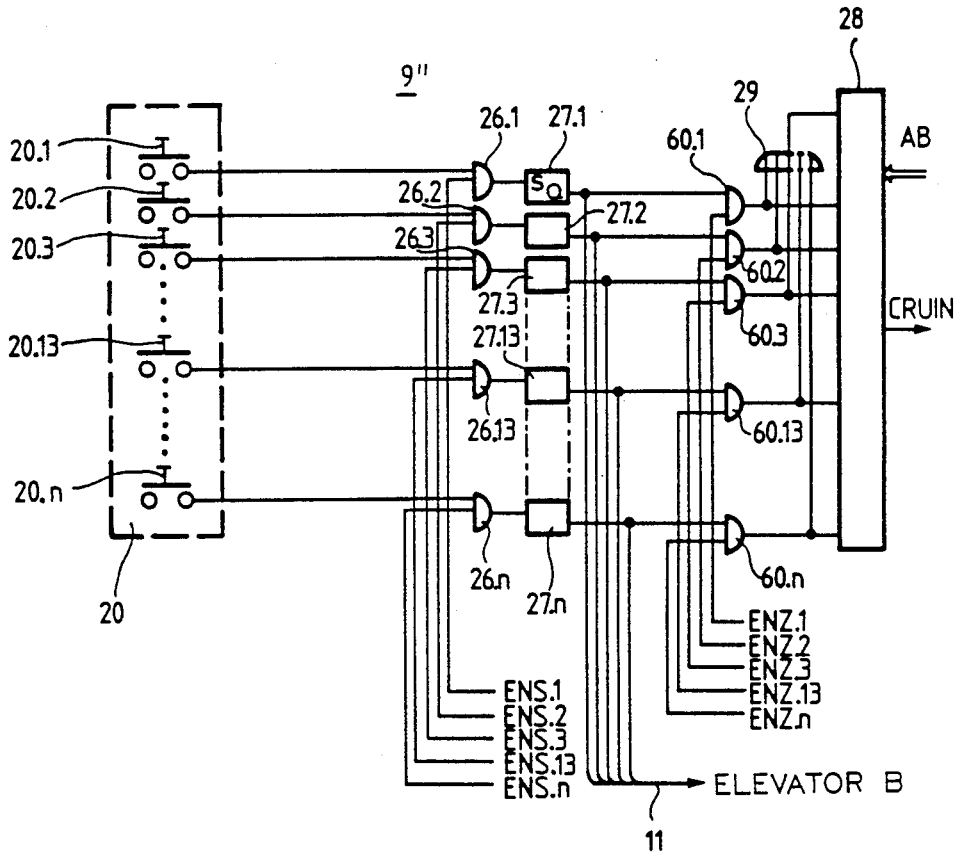
FIG. 8 is a circuit diagram of a second alternate call registering circuit with a keyboard and keys for all destination floors for zonal operation in the control system shown in FIG. 2.

In a further variant of the preferred embodiment, at least one call registering circuit 9" common to the elevator "A" and the elevator "B" is provided according to FIG. 8 at the main stopping location HH in place of the first and second call registering circuits 9 of the FIG. 7. The keyboard 20 has keys 20.1 to 20.n for all destination floors. The input of destination floors of the zone a and of the zone b takes place by way of a keyboard 20 common to the elevators. The switching circuits of FIG. 8 correspond in construction and function to those of the FIG. 6. In the case of elevator groups with single-car elevators, the lines ENS.1 to ENS.n illustrated in FIG. 8 are superfluous.

In a further variant of the preferred embodiment, the call registering circuit 9" can in place of the keyboard be provided with a pulse generator acording to Swiss Patent No. 162 810 in the manner of a telephone number selector which is connected to call memories by way of a circuit for the conversion of the pulse generator numbers into floor numbers. In the variant with the pulse generator, means are provided for the main floor E0, which prevent travels to floors which lie outside the zones allocated to the elevators.

In another variant of the preferred embodiment, the call registering circuit 9" can in place of the keyboard be provided with a decade keyboard according to FIG. 6, which has keys for the input of numerals and control symbols and which is connected up to call memories by way of a circuit for the conversion of the decade keyboard numbers into floor numbers. In the case of elevator groups with single-car elevators, the lines ENS.1 to ENS.n illustrated in FIG. 6 are superfluous.

At least one call registering circuit 9' according to FIG. 6 is provided on the main floor E0 forming the main stopping location HH. The main stopping location HH is not restricted to the named floor. Normally, in the case of single-car elevators, the floor which displays a high traffic volume becomes the main stopping location HH.

Zones adaptable to the traffic volume let themselves be formed by the call registering circuit 9' according to FIG. 6 and according to FIG. 8. The zone formation takes place manually or automatically by means of the lines ENZ.1 to ENZ.n, which are acted on by appropriate signals. In that case, stored destination floor calls which lie outside the zones allocated to the lifts are recognized by the multiplexer 28 and prevented from allocation. The elevator passengers at the main stopping location HH learn, by means of an indicator, which group of destination floors is served by which elevator.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. In an elevator installation which includes at least one elevator having a car provided with at least one compartment, wherein at least one main stopping location and a number of adjacent floors are provided, and command input devices are present for the calling of cars to the floors and for the input of travel destination wishes and the elevator carries out only travel wishes to one certain group of destination floors, the improvement comprising: the command input devices are call registering circuits arranged externally of the car on the floors and including circuit means for the prevention of the execution of travel wishes at least in the direction of travel away from the main stopping location to destination floors lying outside the certain group of destination floors.

2. The improvement according to claim 1 wherein at least one said call registering circuit, including a keyboard having keys for the input of destination floor calls and connected to call memories, is provided for each floor of the elevator installation.

3. The improvement according to claim 1 wherein at least one said call registering circuit includes a keyboard which has only keys for destination floors allocated to the certain group of destination floors.

4. The improvement according to claim 1 wherein at least one said call registering circuit, including a manually actuable pulse generator in the manner of a telephone number selector and connected to call memories by way of a circuit for the conversion of the pulse numbers for said pulse generator into destination floor calls, is provided on each floor of the elevator installation.

5. The improvement according to claim 1 wherein at least one said call registering circuit, including a decade keyboard which has keys for the input of numerals and control symbols and which is connected to call memories by way of a circuit for the conversion of the decade keyboard numbers into destination floor calls, is provided on each floor of the elevator installation.

6. The improvement according to claim 1 wherein said circuit means for the prevention of the execution of travel wishes from the main stopping location to destination floors lying outside the certain group of destination floors includes a call registering circuit with a means for the freeing of the destination floor calls allocated to the certain group of destination floors and for the blocking of the destination floor calls lying outside the certain group of destination floors.

7. The improvement according to claim 6 wherein said means for the freeing and blocking of destination floor calls includes logic signal lines connected to the inputs of logical switching circuits for receiving appropriate logic signals.

8. The improvement according to claim 1 wherein said call registering circuit at the main stopping location includes an indicator which indicates which elevator serves which certain group of destination floors.

9. The improvement according to claim 1 wherein the elevator group has at least two elevators, the certain group of destination floors allocated to a first one of the elevators covers a first zone adaptable to the traffic volume and having at least one of the destination floors and the certain group of destination floors allocated to a second one of the elevators covers a second zone with at least one of the remaining destination floors.

10. The improvement according to claim 9 wherein the elevator group includes multi-car elevators, the main stopping location includes a lower main floor and an upper main floor, and the certain group of destination floors allocated to the first elevator covers the destination floors which are allocated to the lower main floor and the upper main floor and which lie within the first zone, and the certain group of destination floors allocated to the second elevator covers the destination floors which are allocated to the lower main floor and the upper main floor and which lie within the second zone.

11. The improvement according to claim 1 wherein the elevator group includes a multi-car elevator, the main stopping location includes a lower main floor and an upper main floor, and the certain group of destination floors allocated to the lower main floor covers the even-numbered destination floors and that the certain group of destination floors allocated to the upper main floor covers the odd-numbered destination floors.

12. The improvement according to claim 1 wherein the elevator group includes a multi-car elevator, the main stopping location includes a lower main floor and an upper main floor, and the certain group of destination floors allocated to the lower main floor covers the odd-numbered destination floors and that the certain group of destination floors allocated to the upper main floor covers the even-numbered destination floors.

13. A floor call registering circuit for an elevator system comprising: a keyboard having keys for inputting desired destination floors, a plurality of flip-flops, each having an input connected to an associated one of said keys, an OR-element having a plurality of inputs each connected to an associated output of one of said flip-flips, and a multiplexer having a plurality of inputs each connected to an associated output of one of said flip-flops and a first input connected to an output of said OR-element for generating a floor call signal to a control circuit for an elevator.

14. The circuit according to claim 13 including a plurality of AND-elements each having one input connected to one of said keys, an output connected to an associated one of said flip-flop inputs, and a second input connected to a line for receiving a logic signal for controlling the transfer of a floor call signal generated by said key to said flip-flop.

15. The circuit according to claim 13 including a plurality of AND-elements each having one input connected to an output of one of said flip-flops, an output connected to an associated one of said multiplexer inputs, and a second input connected to a line for receiving a logic signal for controlling the transfer of a floor call signal stored in said flip-flop to said multiplexer.

16. The circuit according to claim 13 wherein said keyboard is a decade keyboard and including a combinatorial logic circuit and a time limitation switch connected between said decade keyboard and said flip-flops for decoding a floor call signal entered on said keyboard.

* * * * *